US006345166B1

(12) United States Patent
Sakaizawa et al.

(10) Patent No.: US 6,345,166 B1
(45) Date of Patent: Feb. 5, 2002

(54) DEVELOPER SCRAPING MEMBER AND DEVELOPING APPARATUS

(75) Inventors: Katsuhiro Sakaizawa, Numazu; Yukihiro Ohzeki, Yokohama; Makoto Nonomura, Kawasaki; Manami Sekiguchi, Mishima, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/598,936

(22) Filed: Jun. 22, 2000

(30) Foreign Application Priority Data

Jun. 24, 1999 (JP) ..... 11-178083
Jun. 9, 2000 (JP) ..... 2000-173448

(51) Int. Cl.[7] ..... G03G 15/08
(52) U.S. Cl. ..... 399/283; 399/357
(58) Field of Search ..... 399/283, 281, 399/273, 272, 284, 274, 357; 15/256.5, 256.51, 256.52; 492/49, 53, 56

(56) References Cited

U.S. PATENT DOCUMENTS 4,533,235 A * 8/1985 Uchida ..... 399/357
4,788,570 A * 11/1988 Ogata et al. ..... 399/283
5,287,150 A * 2/1994 Kinoshita et al. ..... 399/281
5,953,557 A * 9/1999 Kawahara ..... 399/281 X
5,953,569 A * 9/1999 Ishikawa ..... 399/281
5,978,635 A * 11/1999 Azuma et al. ..... 399/283

FOREIGN PATENT DOCUMENTS

JP 54-4303 1/1979
JP 58-116559 7/1983
JP 7-036273 * 2/1995

* cited by examiner

*Primary Examiner*—Sophia S. Chen
(74) *Attorney, Agent, or Firm*—Fitzpatrick, Cella, Harper & Scinto

(57) ABSTRACT

A developer scraping member for scraping developer from a developer carrying member has a surface layer having a foamed member, a base layer provided inside of the surface layer, and an intrusion preventing layer provided between the surface layer and the base layer. The intrusion preventing layer prevents the developer, which has intruded into the surface layer, from intruding into the base layer.

56 Claims, 6 Drawing Sheets

DEVELOPER SCRAPING MEMBER AND DEVELOPING APPARATUS

BACKGROUND OF THE INVENTION

1. Field of the Invention

The present invention relates to a developer scraping member for scraping developer from a developer carrying member, and a developing apparatus equipped with such developer scraping member.

2. Related Background Art

In the image forming apparatus such as a copying apparatus, a printer or a facsimile apparatus, there has conventionally been executed visualization of a latent image, formed on an image bearing body such as an electrophotographic photosensitive member or an electrostatic recording dielectric member, as a toner image by development with a developing portion.

As one of such developing portions, there have been proposed and commercialized various types of dry one-component developing portion. However any of these types has been associated with a difficulty in forming a thin layer of non-magnetic toner (non-magnetic one-component toner), which is the non-magnetic one-component developer, on the developer carrying member.

Nevertheless, in order to meet the currently desired improvements in the resolution and definition of the image, the development of the method for forming a thin toner layer and of the apparatus therefor is essential, and certain measures have therefore been proposed.

For example, the Japanese Patent Application Laid-Open No. 54-4303 discloses a method of abutting a metal or rubber elastic blade with a developing roller constituting a developer carrying member and causing the toner to pass between and to be regulated by the elastic blade and the developing roller thereby forming a thin layer of the toner on the developing roller and providing the toner with sufficient triboelectricity by the friction in the abutting portion.

In such method, if the non-magnetic toner is regulated by the elastic blade, there is required a separate toner feeding member for feeding the toner onto the developing roller. This is because the non-magnetic toner cannot be fed by magnetic force, though the magnetic toner can be fed onto the developing roller by the magnetic force of a magnet provided inside the developing roller.

In a developing portion disclosed in the Japanese Patent Application Laid-Open No. 58-116559, as shown in FIG. 8, in a developing container 102 containing non-magnetic one-component toner 106, a fur-brush-like roller (brush roller) 115 contacting a developing roller 103 is provided at an upstream position with respect to an elastic blade 104 in the rotating direction of the developing roller 130 in order to scrape off the residual toner not consumed in the image development but remaining on the developing roller 103 and to feed new toner 106 onto the developing roller 103.

It is thus rendered possible to satisfactorily form a thin layer of the non-magnetic toner 106 on the developing roller 103 and to satisfactorily develop the electrostatic latent image on a photosensitive drum 101, whereby a solid black image of a high density and a large area can be faithfully reproduced in the development to obtain a satisfactory image.

However, the above-described brush roller 115 is formed by planting fibers of nylon or rayon on a metal core, and, in a prolonged repeated use of the developing portion, the fibers become detached from the roller and clogged between the elastic blade and the developing roller, thereby generating a white line (streak) in such clogged portion, or the fibers are turned down on the roller to result in defective contact between the brush roller and the developing roller whereby the solid black image cannot be reproduced sufficiently because of deficient feeding and scraping of the toner.

Therefore, it is proposed to form the toner feeding member by an elastic roller with a foamed structure, composed of an open cell foamed member such as polyurethane foam of a relatively low hardness and to contact such roller with a low pressure to the developing roller, whereby the feeding of the toner onto the developing roller and the scraping of the residual toner therefrom are rendered possible by suitable surface irregularity (asperity) of the foamed member.

In such developing portion, however, since the elastic roller is composed of an open cell foamed member, the toner particles enter and gradually clog the cells of the elastic roller when the developing operation is repeated many times, particularly in case the toner of a small particle size is used under a high humidity environment or the toner is substantially spherical. When the toner clogging spreads over the entire foamed member of the elastic roller, it becomes harder to result in an excessively large contact pressure of the elastic roller on the developing roller, eventually leading to an increased driving torque of the developing roller and the elastic roller or unevenness in the coating and scraping of the toner by the elastic roller on the developing roller, whereby uneven coating is developed on the developing roller in the undesirable level.

In order to prevent the drawbacks resulting from such clogging with toner of the interior of the elastic roller, there can be conceived the following measures: (1) providing the surface of the elastic roller with a skin layer for preventing toner clogging; (2) constituting the elastic roller with a closed cell foamed member; and (3) using an open cell foamed member of a high density with as small cells as possible. These measures, however, result in the following drawbacks.

In the measure (1), when the skin layer of the elastic roller is maintained in contact with and rubs the surface of the developing roller, the skin layer has an excessively strong function of rubbing in the toner onto the developing roller, resulting in the fusion of the toner onto the developing roller or physical change of the toner, thereby causing deterioration of the toner and an increase in the fog level when the developing operation is repeated many times. Even if the surface of the skin layer is made appropriately coarse, it is locally harder than the surface of the foamed member, thus applying a locally high pressure on the toner and the developing roller, so that similar drawbacks cannot be avoided.

Also as the skin layer is formed very thin, it may be abraded or scraped off by the friction with the developing roller, whereby the toner particles still intrude the cells of the foamed member and there cannot be assured the stability in the prolonged use.

In the measure (2), the elastic roller can satisfactory execute coating and scraping of the toner on the developing roller as in the open cell foamed member, but the closed cell foamed member has a higher hardness and a higher repulse elasticity in comparison with the open cell foamed member so that the hardness of the elastic roller becomes excessively high. For this reason, if the elastic roller is so positioned as to be stably and securely contacted with the developing roller, the contact (abutting) pressure of the elastic roller becomes excessively high on the toner and the developing roller, resulting in various drawbacks such as an increased driving torque of the developing roller and the elastic roller and an increased fog level derived from the change of physical property (deterioration) of the toner after a prolonged use.

Such drawbacks may be avoided by reducing the hardness of the closed cell foamed member as far as possible, but, in such case, the foamed member inevitably contains a large amount of an oily component which oozes out and sticks to the developing roller and the toner when the elastic roller is left in contact with the developing roller and the toner over a prolonged period under a high temperature environment, whereby the toner is fused and sticks to the developing roller. With such fusion of the toner on the developing roller, the toner newly fed thereto is rubbed with the fused toner on the developing roller, whereby the appropriate triboelectricity cannot be obtained and a fog is undesirably generated by the deficient charging of the toner.

In the measure (3), in comparison with the open cell foamed member of an ordinary cell number, for example a foamed member with 30 to 50 cell/inch such as polyurethane foam, the open cell foamed member with finer cells such as 100 cell/inch or larger allows to prevent intrusion of the toner into the elastic roller in case of toner particles of irregular form to a certain extent, but is not very effective for the toner of substantially spherical shape. As a result, the hardness of the entire elastic roller becomes excessively high as in the case of measure (2), thus resulting in drawbacks such as an increase in the driving torque of the elastic roller and the developing roller, deterioration of the toner and an increased fog level derived from the toner deterioration.

SUMMARY OF THE INVENTION

An object of the present invention is to provide a developing scraping member capable of satisfactorily scraping the developing from the developing carrying member, and a developing apparatus provided with such developer scraping member.

Another object of the present invention is to provide a developer scraping member capable of satisfactorily scraping and feeding the toner on the developing roller by the elastic roller without excessive pressure on the developing roller and the toner thereon even after prolonged use of the elastic roller in the developing portion, thereby enabling satisfactory image development to provide a high quality image without fog and the like, and a developing apparatus provided with such developer scraping member.

Still another object of the present invention is to provide a developer scraping member for scraping developer from a developer carrying member, comprising:

a surface layer having a foamed member;

a base layer provided inside the surface layer; and an intrusion preventing layer between the surface layer and the base layer, wherein the intrusion preventing layer prevents the developer from intruding into the surface layer from intruding into the base layer.

Still another object of the present invention is to provide a developing apparatus comprising:

a developer carrying member carrying developer; and a developer scraping member for scraping developer from a developer carrying member, including:

a surface layer having a foamed member;

a base layer provided inside the surface layer; and an intrusion preventing layer between the surface layer and the base layer, wherein the intrusion preventing layer prevents the developer intruded into the surface layer from intruding into the base layer.

Still other objects of the present invention, and the features thereof, will become fully apparent from the following description which is to be taken in conjunction with the attached drawing.

DESCRIPTION OF THE PREFERRED EMBODIMENTS

Now the present invention will be clarified in detail by preferred embodiments thereof with reference to the attached drawings.

[Embodiment 1]

Figure 1:
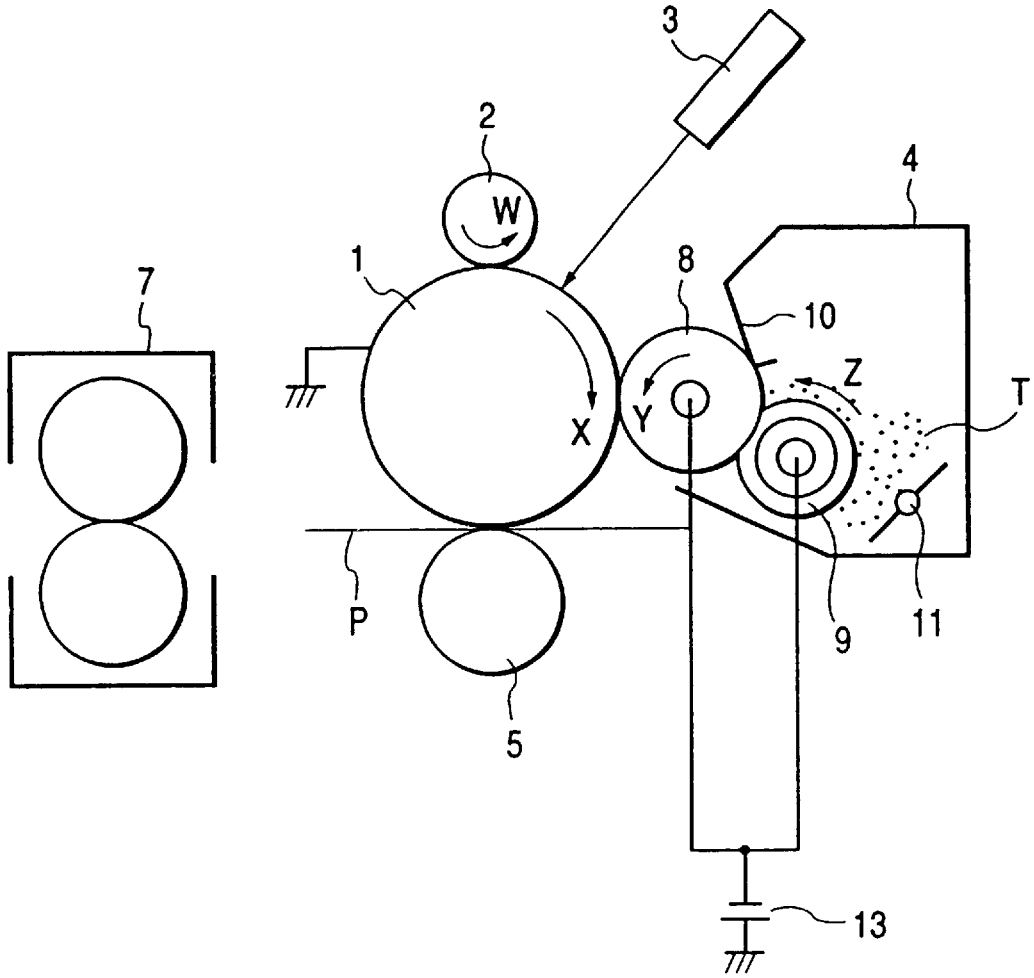
FIG. 1 is a schematic view showing the configuration of an embodiment of the image forming apparatus of the present invention.

FIG. 1 is a schematic view showing the configuration of an embodiment of the image forming apparatus of the present invention.

In the present embodiment, as shown in FIG. 1, the image forming apparatus is provided with a photosensitive drum 1 serving as an image bearing body and rotated in a direction X with a peripheral speed Vx, and there are provided a primary charging roller (primary charger) 2, an exposing portion 3, a developing portion 4, a transfer charger 5 and a fixing portion 7 around the photosensitive drum 1 along the rotating direction thereof.

For image formation, the photosensitive drum 1 is rotated in a direction X and the surface thereof is uniformly charged with the primary charging roller 2 rotating in a direction W. The primary charger 2 is a contact charger for charging the photosensitive drum 1 in contact therewith, and is connected to an unrepresented primary charging bias source. In the present embodiment, the photosensitive drum 1 is rotated with a peripheral speed of Vx=93 mm/sec, while the primary charging roller 2 is rotated at a speed substantially equal to that of the photosensitive drum 1 and is given a voltage of about −1300 V from the primary charging bias source to charge the surface of the photosensitive drum 1 at a potential of about −700 V.

The exposing portion 3 is provided with a light emitting device such as a laser or an LED. The above-mentioned charged photosensitive drum 1 is exposed, by scanning, to a light image corresponding to information signal by the exposing portion 3, whereby an electrostatic latent image corresponding to the information signal is formed on the surface of the photosensitive drum 1, and such latent image is developed by the developing portion 4 as a visible toner image.

The present image forming apparatus employs the reversal developing method for developing the latent image on the photosensitive drum 1. The developing portion 4 utilizes negatively charged toner as non-magnetic one-component toner, which is deposited on the exposed area of the electrostatic latent image on the photosensitive drum 1 to develop the latent image. However, the present invention is not limited to such developing method.

Then the toner image formed on the photosensitive drum 1 is transferred, by the function of the transfer charger 5, to a transfer sheet P fed to the photosensitive drum 1 by unrepresented conveying rollers. In the present embodiment, the transfer charger 5 is composed of roller type, namely a transfer roller, which is given a voltage of about +2 to +5 kV from an unrepresented transfer bias source. After the transfer, the transfer sheet P is conveyed to the fixing portion 7 where the toner image is fixed by thermal fusion to obtain a permanent image on the transfer sheet P.

At the transfer of the toner image onto the above-mentioned recording sheet P, there is generated residual toner that remains, without being transferred, on the photosensitive drum 1, and, in the present image forming apparatus, such residual toner is removed by the cleaning simultaneous with development and is collected, after passing the primary charging roller 2, by the developing roller 8 of the developing portion 4, as will be explained later.

The developing portion 4 contains therein non-magnetic toner (non-magnetic one-component toner) T serving as the one-component developer, and, in an aperture opposed to the photosensitive drum 1 and extending in the longitudinal direction thereof, the above-mentioned developing roller 8 serving as the developer carrying member is positioned in contact with the photosensitive drum 1. The developing roller 8 is composed of an elastic roller, rotated in a direction Y with a peripheral speed Vy. The peripheral speed Vy of the developing roller 8 is selected larger than that Vx of the photosensitive drum 1, and, in the present embodiment, Vy is selected as 145 mm/sec (Vx=93 mm/sec).

In a lower position of the developing roller 8 opposite (at the back) to the photosensitive drum 1, there is contacted an elastic roller 9 serving as the toner feeding member. The elastic roller 9 is rotated a direction Z, opposite to the rotating direction of the developing roller 8, with a peripheral speed Vz. At the back of the developing roller 8, there is provided a toner agitating member 11. A developing blade 10 serving as a toner regulating member is positioned in contact with the developing roller 8, in a downstream position in the rotating direction of the developing roller 8, with respect to the elastic roller 9. Outside the developing portion 4, there is provided a high voltage DC source (developing bias source) 13 for applying a developing bias to the developing roller 8. In the present embodiment, the power source 13 is also connected to the core metal of the elastic roller 9, so as that the elastic roller 9 assumes a same potential.

The non-magnetic toner T in the developing portion 4 is carried to the elastic roller 9, while being agitated by the agitating member 11. The toner T carried to the elastic roller 9, being supported by the surface irregularities and pores thereof, is carried to the developing roller 8 by the rotation of the elastic roller 9. The toner T carried to the developing roller 8 is given triboelectricity at the contact portion of the elastic roller 9 and the developing roller 8 by the difference in the peripheral speed thereof, and is coated onto the developing roller (toner coating). In the present embodiment, the peripheral speed Vz of the elastic roller 9 is selected as Vz=70 mm/sec.

The peripheral speed Vz of the elastic roller 9 is preferably selected as 30 to 80% of the peripheral speed Vy of the developing roller 8. A peripheral speed Vz of the elastic roller not more than 30% of the peripheral speed Vy of the developing roller results in deficient toner feeding to the developing roller 8, whereby a low density results at the rear end of the image when a solid image is formed. Also a peripheral speed Vz of the elastic roller not less than 80% of the peripheral speed Vy of the developing roller results in excessive toner feeding to the developing roller 8, whereby the toner is packed and causes blocking on the periphery of the developing roller 8.

In the present embodiment, as explained in the foregoing, the peripheral speed Vy of the developing roller 8 is 145 mm/sec while that Vz of the elastic roller 9 is 70 mm/sec, so that the peripheral speed Vz of the elastic roller is about 48% of that of the peripheral speed Vy of the developing roller. The relative speed of the elastic roller 9 with respect to the developing roller 8 can be selected within a wide range of 20 to 300 mm/sec, and, since these rollers rotate in the mutually opposite directions, the relative speed is Vz+Vy=215 mm/sec. The contact width (nip width) of the elastic roller 9 and the developing roller 8 has to be selected as about 1 to 10 mm, and is selected as 5 mm in the present embodiment.

The toner T coated on the developing roller 8 is carried to the developing blade 10 by the rotation of the developing roller 8, and is formed into a toner layer of a predetermined thickness by the regulation and friction by the developing blade 10 and is given a charge to a predetermined charge amount. The developing blade 10 is formed by folding a thin stainless steel plate of a thickness of about 0.1 mm into a side opposite to the developing roller 8, at a position of about 2 mm from the front end, and the developing blade 10 is so positioned that the folded portion thereof slightly intrudes into the surface of the developing roller 8.

After the thickness regulation and charging by the developing blade 8, the toner T is carried by the rotation of the developing roller 8 to a developing area opposed to the photosensitive drum 1, and, by the DC voltage applied to the developing roller 8 from the developing bias source 13 and selected as −460 V in the present embodiment, is transferred onto the photosensitive drum 1 in the exposed portion of the electrostatic latent image, thereby executing reversal development thereof and providing a visible toner image.

Cleaning simultaneously with development is executed in the following manner. As explained in the foregoing, residual toner is generated on the photosensitive drum 1 at the transfer of the toner image. Such transfer residual toner, being usually subjected to discharging by the transfer charger 5, becomes charged with a polarity opposite to the normal charging polarity (reversed toner), but is returned to the normal polarity by the friction by the primary charger 2 and the photosensitive drum 1 and by the discharging by the primary charger 2, and, while being carried on the photosensitive drum 1, is emitted from the primary charger 2 onto the photosensitive drum 1 and passes the primary charger 2 in a state carried again on the photosensitive drum 1.

Among such transfer residual toner on the photosensitive drum 1, that present in the non-image area on the photosensitive drum 1 is removed therefrom and is collected by the developing roller 8, at the contact portion of the photosensitive drum 1 and the developing roller 8 by the potential difference between the charged potential (−700 V) of the photosensitive drum 1 and the developing bias (−460 V) applied to the developing roller 8. The toner collected by the developing roller 8 is scraped by the elastic roller 9, together with the development residual toner on the developing roller 8.

Figure 3:
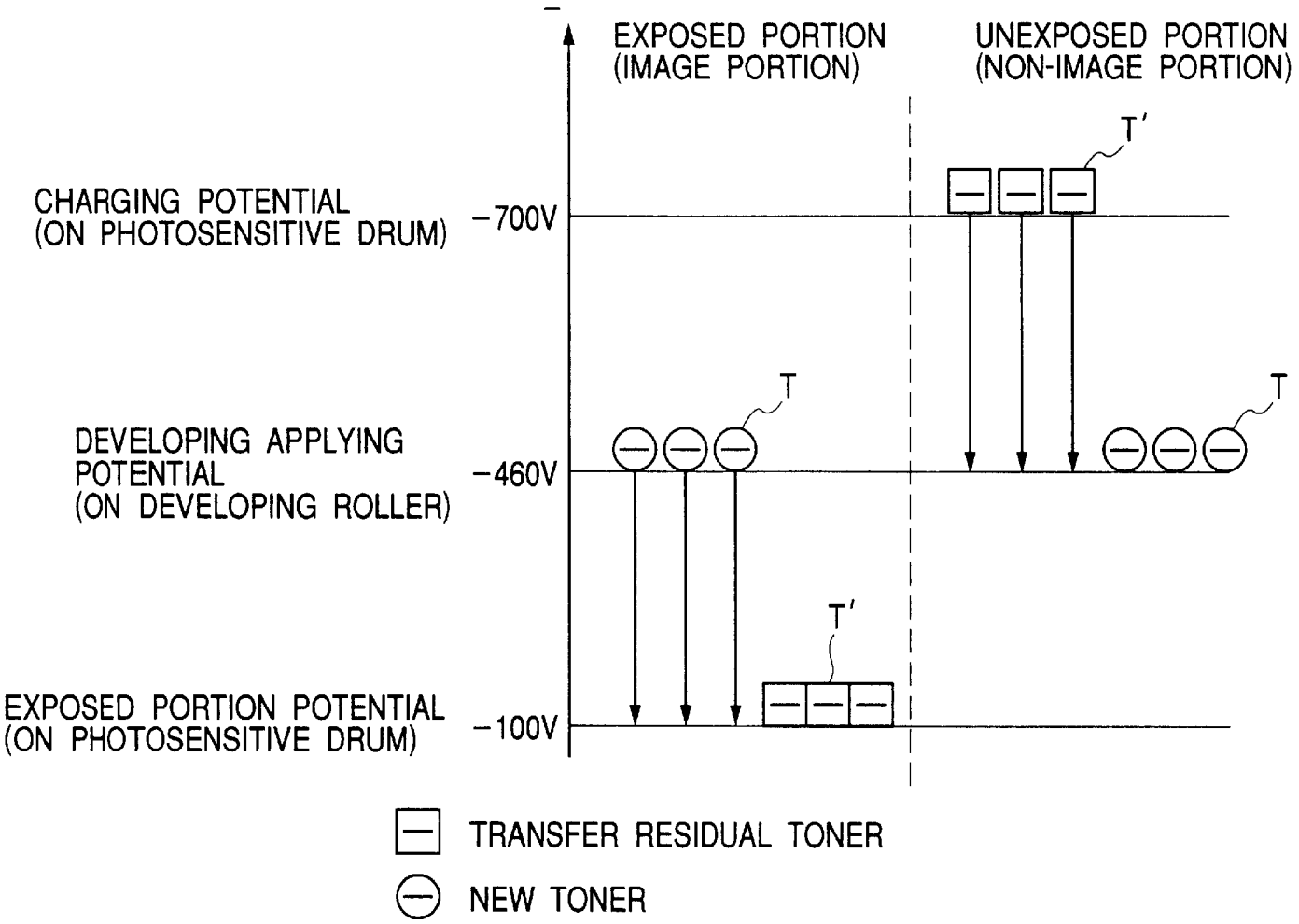
FIG. 3 is a potential chart showing a cleaning operation simultaneous with development for the transfer residual toner in the developing operation by the developing portion in the image forming apparatus shown in FIG. 1.

Cleaning simultaneously with developing will be explained further with reference to FIG. 3, in which are shown are transfer residual toner T' on the photosensitive drum 1 and new toner T carried on the developing roller 8 prior to the development. The transfer residual toner T' and the new toner T are both negatively charged.

The electrostatic latent image on the photosensitive drum 1, namely the potential of the exposed area (image area), is shifted to about −100 V by the exposure. In this state, the transfer residual toner T' remains on the photosensitive drum 1, while the toner T on the developing roller 8 is shifted onto the exposed area on the photosensitive drum 1, by the potential difference between the developing bias −460 V and the potential −100 V of the exposed area on the photosensitive drum 1, thereby developing the electrostatic latent image thereon.

At the same time, the negatively charged transfer residual toner T' in the non-exposed area (non-image area) is transferred (cleaned) to the developing roller 8, by the potential difference between the potential −700 V of the non-exposed area (potential of the non-image area or potential of primary charging) and the developing bias of −460 V, and is collected in the developing portion 4. In this state, the toner T on the developing roller 8 remains thereon. In this manner there is executed cleaning simultaneously with developing.

In case a large amount of toner is collected by the developing roller 8 by a jamming of the transfer sheet in the course of an image formation, the developing roller will carry the toner of an amount in excess of the amount regulated by the developing blade 10. Also in such case, according to the present invention, the toner does not intrude into the elastic roller 9 serving to scrape the toner on the developing roller 8, so that the elastic roller 9 is not hardened, whereby the toner can be collected without deterioration.

Figure 2:
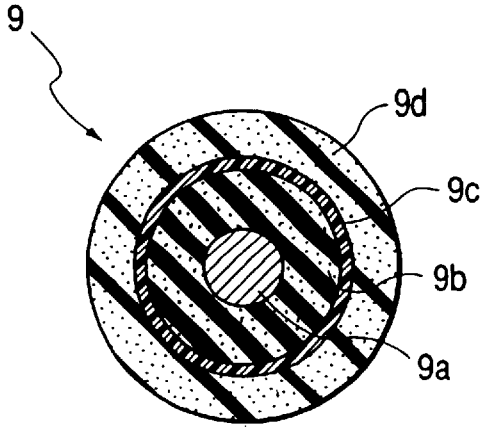
FIG. 2 is a cross-sectional view of an elastic roller serving as a toner supplying (feeding) member in a developing portion provided in the image forming apparatus shown in FIG. 1.

In the following there will be given an explanation on the elastic roller 9, constituting the most important feature of the present invention. As shown in FIG. 2, the elastic roller 9 has a multi-layered structure composed, on a conductive core metal 9*a,* of a base layer 9*b* consisting of an open cell foamed member, a toner intrusion preventing layer 9*c* and a toner scraping layer 9*d,* formed in concentric circles from the inside to the outside. In the present embodiment, the base layer 9*b,* toner intrusion preventing layer 9*c* and toner scraping layer 9*d* are made electrically insulating, and the core metal 9*a* is connected, as explained in the foregoing, to the developing bias source 13 to maintain the elastic roller 9 at a potential same as that of the developing roller 8 at the image development.

In the present invention, as explained in the foregoing, the toner intrusion preventing layer 9*c* is inserted between the base layer 9*b* and the toner scraping layer 9*d,* in order to achieve following effects:

(1) Firstly, it can carry the toner of a desired amount to the developing roller 8, while preventing the intrusion of the toner into the interior of the elastic roller 9.

The outermost layer of the elastic roller 9 has two functions of toner feeding to the developing roller 8 and scraping of the residual toner that has not contributed to the development. The toner on the developing roller 8 is scraped mechanically by the friction of the edge portion of foamed cells, but the scraped toner, even if entering the foamed member, is blocked by the intrusion preventing layer 9*c,* so that the hardness of the entire elastic roller 9 is scarcely increased.

In case the outermost layer is composed of solid rubber or closed-cell sponge rubber, the carried amount of toner tends to be lowered so that it becomes difficult to carry the toner amount required for development on the developing roller 8, but, in case of an open cell foamed member, the developing roller 8 can carry the necessary amount of toner since the toner can be contained in the cells.

As a result, it is rendered possible to carry the desired amount of toner on the developing roller 8, while preventing intrusion of the toner into the interior of the elastic roller 9.

Also the toner contained in the cells of the scraping layer 9*d,* being positioned close to the surface of the elastic roller 9, has a high probability of immediately carried by the developing roller 8, so that it is free from staying in a same position for a long time and being repeatedly rubbed, and can be prevented from deterioration resulting from such phenomena. Such prevention of toner deterioration is particularly important since the cleaning method simultaneous with development re-uses the collected toner;

(2) Secondly, it can functionally separate the base layer 9*b* and the scraping layer 9*d.*

The conventional elastic roller employing a single layer of the open cell foamed member has a limited freedom of material selection, since the material constituting the elastic roller has to be selected in consideration of the toner feeding and scraping on the developing roller 8, the durability of the elastic roller and the charging property on the toner, and so as not to apply an excessive pressure to the developing roller 8.

In contrast, as the base layer 9*b* does not directly contribute to the scraping of the toner on the developing roller 8, the diameter of the foamed cells and the hardness can be selected so as not to apply an excessive pressure on the developing roller 8, and the freedom is widened in the selection of the material such as rubber. More specifically, the cell diameter, cell density and rubber hardness of the base layer 9*b* can be selected within such a range not causing a permanent deformation, whereby the roller 9 can be so formed as to have a wide contact nip with the developing roller 8 and not to apply an excessive pressure thereon.

The thickness of the scraping layer 9*d* can be selected within a range from 0.5 to 3 mm. A thickness not more than 0.5 mm reduces the carried amount of toner, so that it becomes difficult to carry the toner of the desired amount. On the other hand, a thickness not less than 3 mm results in an excessive toner amount in the scraping layer, whereby the hardness thereof is elevated and the effects of the present invention cannot be attained.

The proportion of the thickness of the scraping layer 9*d* in the entire layers (base layer 9*b,* toner intrusion preventing layer 9*c* and scraping layer 9*d*) is preferred to be not more than 50%. A proportion exceeding 50% reduces the proportion of the base layer 9*b,* whereby the desired hardness of the roller becomes difficult to obtain because of the influence of the metal core 9*a.*

In the present embodiment, the core metal 9*a* of the elastic roller 9 was composed of stainless steel with an external diameter of 5 mm. The base layer 9*b* thereon was formed by open cell foamed urethane rubber sponge (density 0.030 g/cm$^3$, cell diameter 200 to 350 $\mu$m, rubber hardness 4° (Asker C hardness)) with a thickness of 4.5 mm, and the toner intrusion preventing layer 9*c* was formed as a skin layer at the surface of the base layer 9*b,* obtained in forming the open cell foamed member. The toner intrusion preventing layer 9*c* was formed with a thickness of about 10 $\mu$m. On the toner intrusion preventing layer 9*c,* the toner scraping layer 9*d* was formed by open cell foamed urethane rubber sponge (density 0.042 g/cm$^3$, cell diameter 100 to 180 $\mu$m, rubber hardness 20° (Asker C hardness)) with a thickness of 1 mm.

The diameter means the averaged diameter of the foamed cells in an arbitrary cross section. The area of a largest cell is measured on a magnified image of an arbitrary cross section, and the largest cell diameter is obtained by converting the measured area into a diameter corresponding to a true circuit. Then the cells of which the diameters are not more than ½ of such largest cell diameter are eliminated as noises, and the areas of the remaining cells are individually converted in a similar manner into the cell diameters, which are then averaged to obtain the averaged diameter.

Thus there was obtained the elastic roller with an external diameter of 16 mm. The base layer 9*b,* toner intrusion preventing layer 9*c* and scraping layer 9*d* were insulating. The rubber hardness was measured with Asker C rubber hardness meter (Kobunshi Keiki Co., Ltd.).

The base layer 9*b* and the scraping layer 9*d* may be composed, instead of urethane rubber mentioned above, of ordinarily employed rubber such as NBR rubber (nitrile rubber), silicone rubber, acrylic rubber, hydrine rubber, ethylene-propylene rubber (EPDM rubber), chloroprene rubber, styrene-butadiene rubber, isoprene rubber, acrylonitrile-butadiene rubber or a compound mixture thereof.

In the following there will be explained the method for producing the elastic roller in the present invention.

At first a metal core 9*a* of the elastic roller 9 as shown in FIG. 2 is prepared, then is coated with an adhesive material on the external periphery and is set a molding cavity of a cylindrical mold. Then isocyanate in liquid state and polyol, mixed in advance with ethylene oxide, are simultaneously fed into the cavity, and are maintained for about 30 minutes in an atmosphere regulated in advance at about 60° C. to complete the reaction. This is so-called one-shot molding, by which the base layer 9*b* of the urethane sponge is molded. After the completion of the reaction, the base layer 9*b* is taken out from the mold. The gas generated by foaming at the sponge formation is extracted from the upper part of the mold. On the surface of the base layer 9*b* of thus formed intermediate molded product, a skin layer is formed along the internal wall of the mold and functions as the toner intrusion preventing layer 9*c* mentioned above.

The toner scraping layer 9*d,* constituting the outermost layer, can be formed by a similar molding operation on the base layer 9*b,* after masking the end portions of the above-mentioned base layer 9*b.* As a skin layer is formed also on the surface of the scraping layer 9*d,* it is polished off by a cylindrical polishing machine, after extraction from the mold, to obtain the scraping layer 9*d* of the predetermined thickness. The skin layer is polished off, because the toner carrying ability of the elastic roller is lowered if the skin layer remains on the scraping layer 9*d,* and also because the skin layer may be scraped off by the friction with the developing roller 8 in the prolonged use if the scraping layer is of a low hardness, so that the skin layer is preferably absent from the beginning.

In the following there will be explained various members constituting the developing portion 4 employed in the present invention.

In the present embodiment, the developing roller 8 is obtained by forming, on a solid cylindrical metal rod of an external diameter of 8 mm, an elastic layer consisting of silicone rubber with a thickness of about 4 mm, so as to obtain an external diameter of 16 mm. For the elastic layer there can be employed, in addition to silicone rubber, ordinarily employed rubber such as NBR rubber, butyl rubber, natural rubber, acrylic rubber, hydride rubber, urethane rubber, ethylene-propylene rubber, chloroprene rubber, styrene-butadiene rubber, isoprene rubber, acrylonitrile-butadiene rubber or a mixture thereof.

The hardness of such rubber material is usually lowered by an increase in the oil content therein. In case the developing roller 8 is composed of a single layer, and in case of employing negatively charged toner, the urethane rubber, silicone rubber or NBR rubber can be utilized advantageously in consideration of providing the toner with appropriate chargeability. In case of employing positively charged toner, fluorinated rubber or the like can be advantageously employed. Also if a coated layer is provided on the external periphery of the elastic layer in consideration of the charging of the toner, there can be advantageously employed polyamide resin, silicone resin, acrylic resin, fluorinated resin or a mixture thereof.

The surface roughness of the developing roller 8 is preferably within a range of 3 to 15 $\mu$m in the ten-point averaged roughness Rz, though it depends also on the particle size of the toner to be used. If the particle size of the toner to be used is 6 $\mu$m in the volume averaged particle size, the surface roughness Rz can be within a range of 5 to 12 $\mu$m. For a smaller toner particle size, the surface roughness Rz is preferably made somewhat smaller. A surface roughness Rz not more than 3 $\mu$m cannot provide a sufficient toner carrying ability, thus resulting in a deficient image density, while a surface roughness not less than 15 $\mu$m is unable to sufficiently charge the residual toner, whereby the residual toner may not be satisfactorily collected or the toner may be deposited on the non-image area thereby forming image fog.

The ten-point averaged roughness was measured with a surface roughness tester SE-30H (Kosaka Laboratory Ltd.) and according to the method defined in JIS B 0601.

The dynamic friction coefficient on the surface of the developing roller 8 is advantageously within a range of 0.02 to 0.8, preferably 0.02 to 0.4. As it is required to return the residual toner, that is charged with the opposite polarity, to the normal charging polarity, a dynamic friction coefficient not more than 0.02 is inadequate in consideration of the charging of the toner, while that not less than 0.8 is undesirable since the toner scattering around the image area increases in the image development.

Figure 4:
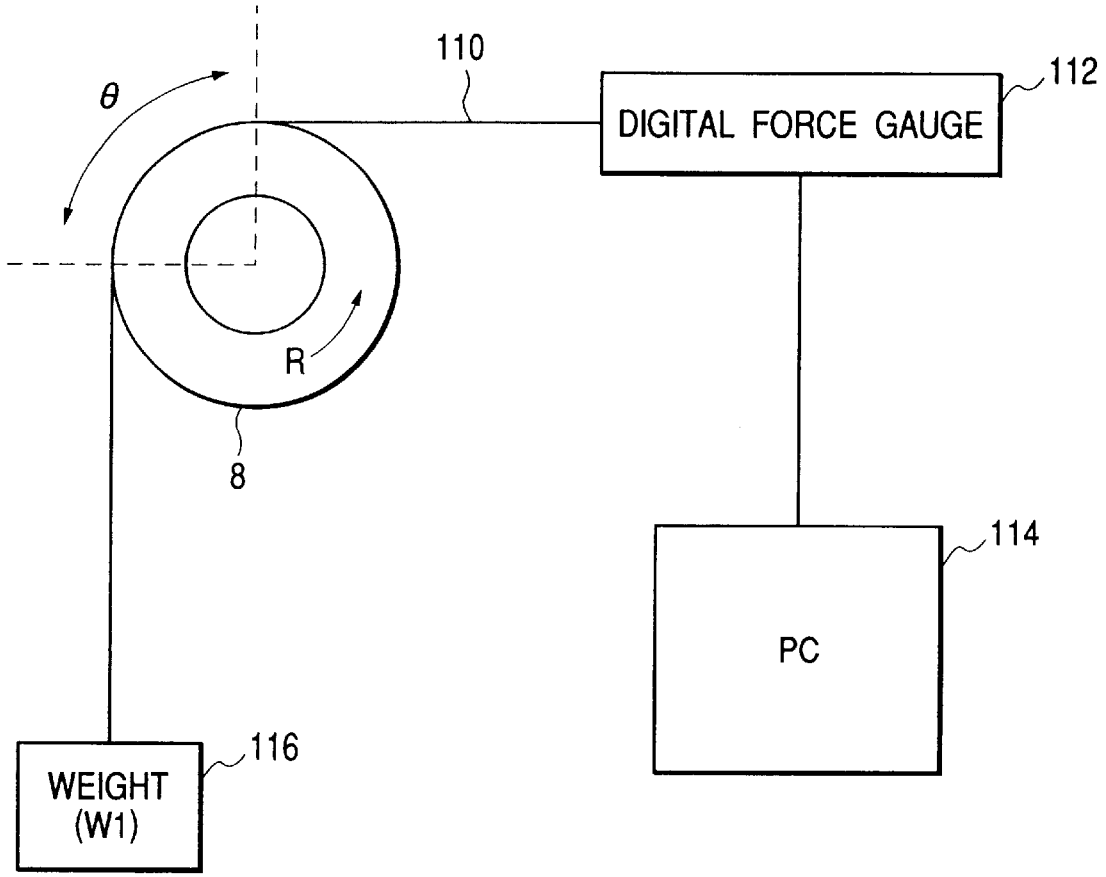
FIG. 4 is a schematic view showing a method for measuring the dynamic friction coefficient of the developing roller of the developing portion.

FIG. 4 shows the measuring method for the dynamic friction coefficient in the present invention. On the periphery of the developing roller 8, there is placed a thin stainless steel plate 110 of a thickness of 0.03 mm and a weight W2, and an end of such thin plate is horizontally extended and connected to a digital force gauge 112 while the other end is vertically pulled down by a weight 116 of a weight W1, in such a manner that the thin plate 110 is in contact with the surface of the developing roller 8 over an angular range of $\theta$=90°. The digital force gauge 112 is adjusted to zero, in a non-load state without the thin plate 110 and the weight W1.

Then the thin plate 110 and the weight W1 are attached, and, when the indication of the digital force gauge 112 is stabilized, the developing roller 8 is rotated counterclockwise as indicated by an arrow R, thus rubbing the stainless steel plate 110, and the frictional force between the developing roller 8 and the thin stainless steel plate 110 is measured by the digital force gauge 112. The analog output from the digital force gauge 112 is sampled at a frequency of 10 Hz, and the sampled data are introduced into a computer 114, and the dynamic friction coefficient is calculated according to the following equation (1). This operation is executed over the entire periphery of the developing roller 8 and the dynamic friction coefficient of the developing roller is determined by averaging the obtained values.

$$\mu=1/\theta\times 1n(F/W) \quad (1$$

wherein $\mu$: dynamic friction coefficient ($\theta$=90°, W: W1+W2, W1: weight of the weight, W2: weight of the thin stainless steel plate, and F: indication of the digital force gauge.

Since the photosensitive drum is composed of a substrate for example of aluminum and a photosensitive layer of a thickness of several ten microns thereon, the dynamic friction coefficient of the surface of the developing roller 8 can be appropriately approximated on the stainless steel plate.

The developing blade 10 serving as the toner regulating member is formed, as explained in the foregoing, by folding a thin stainless steel plate of a thickness of about 0.1 mm at a position of about 2 mm from the front end, and is so positioned that the folded portion somewhat intrudes the surface of the developing roller 8. The linear contact pressure is preferably within a range of about 10 to 45 gf/cm (0.098 to 0.441 N/cm), as a contact pressure not more than 10 gf/cm (0.098 N/cm) is incapable of providing the toner with an appropriate charge, thereby forming fog to deteriorate the image quality. Also if a contact pressure exceeds 45 gf/cm, the external additive mixed in the toner tends to be separated from the toner surface for example by a pressure, whereby the toner is deteriorated to reduce the chargeability thereof.

In the present embodiment, the developing blade 18 is composed of a folded stainless steel plate which is maintained in edge contact at the folded portion with the developing roller 8, but it is also possible to employ a thin metal plate of linear flat shape and to maintain such plate in face contact with the developing roller 8. In such case the contact pressure is preferably made higher by 5 to 10 gf/cm (0.049 to 0.098 N/cm) than in the case of edge contact.

The linear contact pressure of the developing blade 10 is measured in the following manner. There are prepared a drawn plate consisting of a thin stainless steel plate of a length of 100 mm, a width of 15 mm and a thickness of 30 $\mu$m, and a sandwiching plate consisting of a thin stainless steel plate of a length of 180 mm, a width of 30 mm and a thickness of 30 $\mu$m folded into a half length. The drawn plate is inserted between the folded sandwiching plate, and the both plates in such inserted state are inserted between the developing roller 8 and the developing blade 10. Then the drawn plate is drawn out at a constant speed by a spring scale attached to the drawn plate, and the load (gf) of the spring scale is read during such drawing operation. The indication of the spring scale is divided by 1.5 to obtain a load per centimeter, whereby the linear contact pressure (gf/cm) of the developing blade 10 can be obtained.

The contact pressure of the developing roller 8 on the photosensitive drum 1, measured similarly to the above-explained measurement of the contact pressure of the developing blade 10, is preferably within a range of 10 to 50 gf/cm (0.098 to 0.49 N/cm). A contact pressure not more than 10 gf/cm results in an unstable contact state, while a contact pressure not less than 50 gf/cm facilitates separation of the external additive, mixed to the toner, for example by pressure, thereby inducing deterioration of the toner and reduces the chargeability of the toner by the developing blade 10.

The contact area between the developing roller 8 and the photosensitive drum 1 preferably has a length of 0.5 to 3 mm, though such contact area depends also on the external diameters of these members. A length of the contact area exceeding 3 mm elongates the time during which the toner is rubbed by the developing roller 8 and the photosensitive drum 1, whereby heat is accumulated in the toner to result in deterioration of the toner. More preferably the length of the contact area is within a rang of 0.7 to 1.5 mm.

The contact pressure of the developing roller 8 and the elastic roller 9, measured similarly to the above-explained measurement of the contact pressure of the developing blade 10, is preferably within a range of 15 to 70 gf/cm (0.147 to 0.686 N/cm). A contact pressure not more than 15 gf/cm generates so-called ghost phenomenon because of the hysteresis of the preceding image, while a contact pressure not less than 70 gf/cm improves the scrapability of the toner but results in an excessive stress on the toner, even in an elastic roller composed of a sponge member with cells, thereby accelerating the toner deterioration.

In the present invention, in the non-magnetic one-component toner, in the observation of cross section of the toner particles under a transmission electron microscope (TEM), the wax component is preferably not dissolved with the binding (binder) resin but is dispersed therein in the form of islands of substantially spherical and/or spindle shape. The dispersion of the wax component as explained above and the inclusion thereof within the toner particle allow to avoid the deterioration of the toner and the contamination of the image forming apparatus, thereby maintaining the satisfactory chargeability and enabling to form the toner image, excellent in dot reproducibility, over a prolonged period. Also the wax component functions effectively under heating, thereby providing satisfactory fixing property at a low temperature and satisfactory antioffset property.

The cross section of the toner particles can be observed by sufficiently dispersing the toner particles in epoxy resin settable at the normal temperature, then setting the dispersion for 2 days at 40° C., dyeing the obtained hardened product with ruthenium tetraoxide, eventually with osmium tetraoxide, cutting thin specimens with a microtome equipped with a diamond blade, and observing the cross sectional shape of the toner particles under a TEM.

Figure 5A:
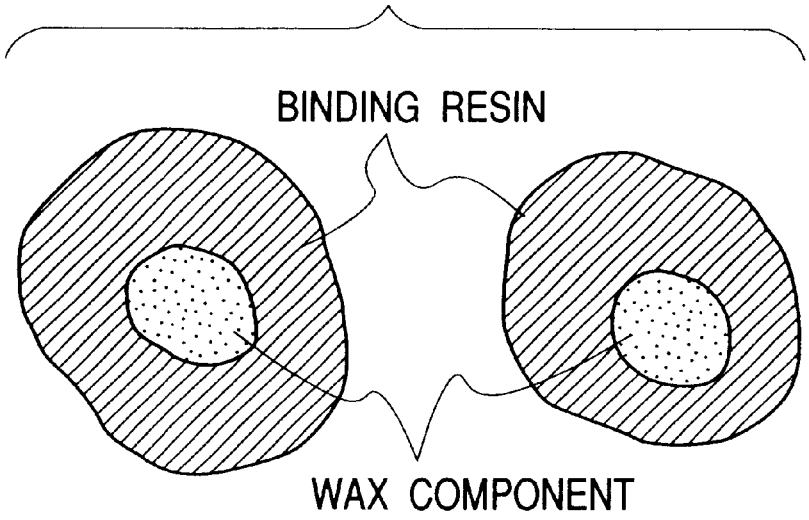
FIGS. 5A and 5B are schematic views showing representative examples of the cross-sectional structure of the toner to be employed in the present invention.
Figure 5B:
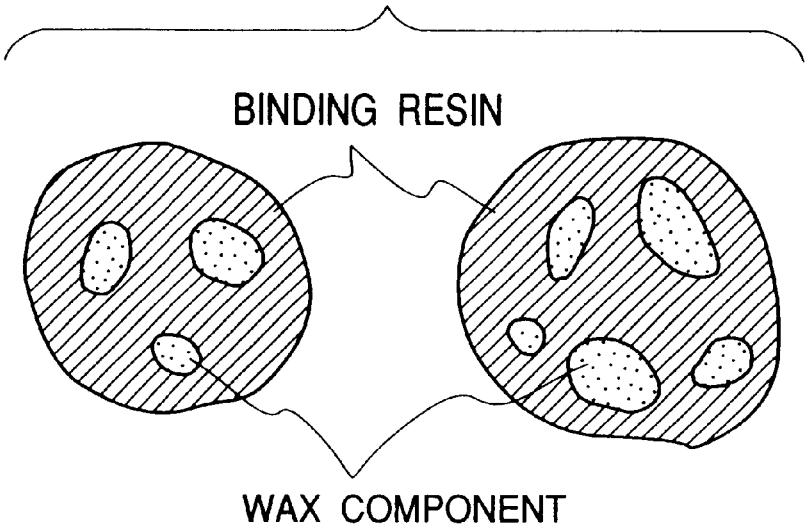

In such observation of the cross sectional shape, in order to improve the contrast between the materials utilizing the slight difference in the crystallinity between the wax component and the resin constituting the outer shell, it is preferable to use the ruthenium tetraoxide dyeing method. FIGS. 5A and 5B schematically show two representative examples of the cross sectional structure of the toner particles thus observed. In the toner particles employed in the present embodiment, it was observed that the wax component was included in the outer shell resin.

There is employed a wax component showing the maximum heat absorption peak in an area of 40° to 130° C. at the temperature elevation, in the DSC curve measured by a scanning differential calorimeter. The presence of the maximum heat absorption peak in the above-mentioned temperature range contributes significantly to the image fixation at a low temperature and effectively attains the releasing property. If the maximum heat absorption peak is positioned lower than 40° C., the self cohering force of the wax component is lowered, thereby deteriorating the anti-offset property at a high temperature and excessively increases the gloss. On the other hand, if the maximum heat absorption peak is positioned higher than 130° C., the fixing temperature becomes higher and the appropriately smoothed surface becomes difficult to realize in the fixed image, whereby the color mixing property is undesirably lowered particularly in the case of using the color toners.

Also in the case of directly forming the toner particles by a polymerization method executing polymerization and particle formation in an aqueous medium, if the maximum heat absorption temperature is positioned at a high temperature, there will result undesirable drawbacks such as separation of the wax component in the course of particle formation.

The maximum heat absorption peak temperature of the wax component is measured according to ASTm D 3418-8, utilizing for example DSC-7 (Perkin Elmer Corp.). The detector of the measuring apparatus is calibrated for the temperature by the fusing points of zinc and indium, and for the heat amount by the fusing heat of indium. The specimen for measurement is placed in an aluminum pan, while an empty pan is for reference, and the measurement is conducted at a temperature increasing rate of 10° C./min, after hysteresis is recorded by a temperature rise-fall cycle.

The above-mentioned wax component can be paraffin wax, polyolefin wax, fisher tropisch wax, amide wax, a higher fatty acid, ester wax, a derivative thereof, or a graft/block polymer thereof.

In the present invention, the toner preferably has a shape factor SF-1 of 100 to 160 and a shape factor SF-2 of 100 to 140, measured by an image analysis apparatus, more preferably a shape factor SF-1 of 100 to 140 and a shape factor SF-2 of 100 to 120. Under these conditions, the ratio SF-2/SF-1 is made not more than 1.0, in order to obtain satisfactory properties of the toner and extremely satisfactory matching with the image analysis apparatus.

In the present invention, the shape factors SF-1, SF-2 are defined by arbitrarily sampling images of 100 toner particles, magnified 500 times by the Hitachi FE-SEM (S-800), analyzing the image information by an image analysis apparatus Lusex3 (Nicolet Japan Corp.) through an interface and executing calculation according to the following equations:

$$SF\text{-}1=\{(\mathrm{MXLNG})^2/\mathrm{AREA}\}\times(\pi/4)\times(100)$$

$$SF\text{-}2=\{(\mathrm{PERI})^2/\mathrm{AREA}\}\times(1/4\pi)\times(100)$$

wherein AREA: projected area of toner, MXLNG: absolute maximum length, and PERI: peripheral length.

The shape factor SF-1 indicates the circularity of the toner particle, which shifts from spherical shape to amorphous shape as the shape factor SF-1 increases. SF-2 indicates the surface asperity (irregularity) of the toner particle, which shows more conspicuous surface irregularity as SF-2 increases.

If SF-1 exceeds 160, the toner shape becomes unstable, whereby the toner shows a broad distribution of the charge amount and the toner surface tends to be ground or milled in the developing portion, resulting in a lowered image density and image fog.

Also in case a potential difference is provided between the elastic roller 9 and the developing roller 8 for biasing the toner toward the developing roller, the toner particles intruding the scraping layer of the elastic roller are not caught in the cells therein because of absence of the surface irregularities, and move faithfully following the bias potential. As a result, the toner of the desired amount can be fed to the developing roller 8, and the toner does not continue to remain in the scraping layer, whereby the deterioration of the toner can be prevented.

For improving the transfer efficiency of the toner image, it is preferred that the shape factor SF-1 is within a range of 100 to 140 while the ratio SF-2/SF-1 is preferable to be not more than 1.0. If the ratio SF-2/SF-1 exceeds 1.0, the surface of the toner particles is not smooth but has many irregularities, so that the transfer efficiency from the photosensitive drum to the transfer material (for example paper) tends to be deteriorated.

In the present invention, in order to faithfully develop small dots of the latent image for improving the image quality, the toner particle size is preferably to be not more than 10 $\mu$m in the weight averaged particle size, more preferably within a range of 4 to 8 $\mu$m, and the fluctuation factor (A) in the number distribution is preferably to be not more than 35%.

The particle size distribution of the toner can be measured by various methods. In the present invention, the measurement was carried out with a Coulter counter.

For example, the measuring apparatus was composed of Coulter counter TA-II (Coulter Inc.), connected to an interface (Nikkaki Co., Ltd.) for outputting number distribution and volume distribution, and a personal computer. The electrolyte was composed of 1% NaCl aqueous solution prepared with sodium chloride. The 1% NaCl aqueous solution is also commercially available, for example ISOTON II (Coulter Scientific Japan Co.).

100 to 150 ml of the above-mentioned electrolyte was added with, as a dispersant, a surfactant preferably alkylbenzene sulfonate salt in an amount of 0.1 to 5 ml, and with 2 to 20 mg of the toner specimen to be measured. The electrolyte in which the specimen was suspended was subjected to dispersion for 1 to 3 minutes by an ultrasonic disperser. Then the particle size distribution of the toner particles of 2 to 40 $\mu$m, based on the number of particles, was measured by the above-mentioned Coulter counter TA-II, for example with an aperture of 100 $\mu$m, and the particle size distribution of the present invention was determined.

The fluctuation factor A in the number distribution of the toner particles is defined by:

$$A=(S/D1)\times 100$$

wherein S: standard deviation in the number distribution of the toner particles

D1: number-averaged particle size ($\mu$m) of the toner particles.

The toner particles are preferably covered with an external additive, in order that the toner particles can be given a desired charge amount. The coverage rate of the toner particle surface with the external additive is preferably 5 to 99%, more preferably 10 to 99%.

The coverage rate of the toner particle surface is obtained by arbitrarily sampling 100 images of the toner particles with a FE-SEM (S-800) manufactured by Hitachi, and introducing the image information into an image analysis apparatus Lusex3 (Nicolet Japan Corp.). The image information, showing different luminances in the surface portion and the external additive portion of the toner particle, is binarized and there are determined an area SG of the external additive portion and an area ST of the toner particle (including the external additive portion). The external additive coverage rate is determined by:

$$\text{External additive coverage rate } (\%)=(SG/ST)\times 100.$$

The external additive preferably has a particle size not more than 1/10 of the weight-averaged particle size of the toner particle, in consideration of the durability in a state added to the toner particle. In the present invention, the particle size of the external additive means an averaged particle size determined from the observation of the toner particle surface under an electron microscope.

The external additive can be, for example, a metal oxide (aluminum oxide, titanium oxide, strontium titanate, cerium oxide, magnesium oxide, chromium oxide, tin oxide, zinc oxide etc.), a nitride (silicon nitride etc.), a carbide (silicon carbide etc.), a metal salt (calcium sulfate, barium sulfate, calcium carbonate etc.), a metal salt of a fatty acid (zinc stearate, calcium stearate etc.), carbon black or silica.

Such external additive is employed in 0.01 to 10 parts by weight, preferably 0.05 to 5 parts by weight, with respect to 100 parts by weight of the toner particles. Such external additive may be used singly or in combination. Each external additive is more preferably subjected to hydrophobic treatment.

An amount of the external additive less than 0.01 parts by weight deteriorates the fluidity of the toner, thus lowering the efficiency of transfer and development, resulting an uneven image density and toner scattering around the image area. On the other hand, an amount of the external additive exceeding 10 parts by weight results in sticking of the external additive to the photosensitive drum or the developing roller, thereby deteriorating the chargeability of the toner or disturbing the image.

In the present embodiment, the elastic roller 9 was installed in the developing portion 4 shown in FIG. 1 and was subjected to 2000 image formations, with an abutting (contact) pressure of 80 gf/cm (0.3724 N/cm) between the developing roller and the elastic roller. At the development, the developing bias was supplied from the developing bias source 13 to the metal core 9*a* of the elastic roller 9, thereby maintaining the elastic roller 9 at a potential the same as that of the developing roller 8. As a result, even when polymerized toner of a small particle size was employed as the non-magnetic one-component toner T, there could be obtained satisfactory image faithful to the image information from the beginning to the end of 2000 image formations, without image unevenness resulting from the toner clogging in the elastic roller 9, or an increase in the driving torque of the developing roller 8 or the elastic roller 9, or toner deterioration resulting from the excessive contact pressure on the developing roller 8 or on the toner, or a resulting increase in the fog level or a resulting decrease in the charge amount.

In the present embodiment, as explained in the foregoing, the elastic roller serving as the toner feeding member to the developing roller is constructed by inserting a toner intrusion preventing layer between a base layer composed of an open cell foamed member and an outermost toner scraping layer on a conductive metal core, whereby the toner of a desired amount can be fed to the developing roller while the intrusion of toner into the interior of the elastic roller is prevented. Also as the base layer and the scraping layer are functionally separated, the elastic roller can provide a wide contact nip with the developing roller without applying an excessive pressure thereon even after a prolonged use, and the freedom of material selection thereof is widened. The present embodiment can execute satisfactory development to provide a high quality image without fog, and the high image quality can be maintained over a prolonged period even in case of employing cleaning method simultaneous with development.

[Embodiment 2]

Figure 6:
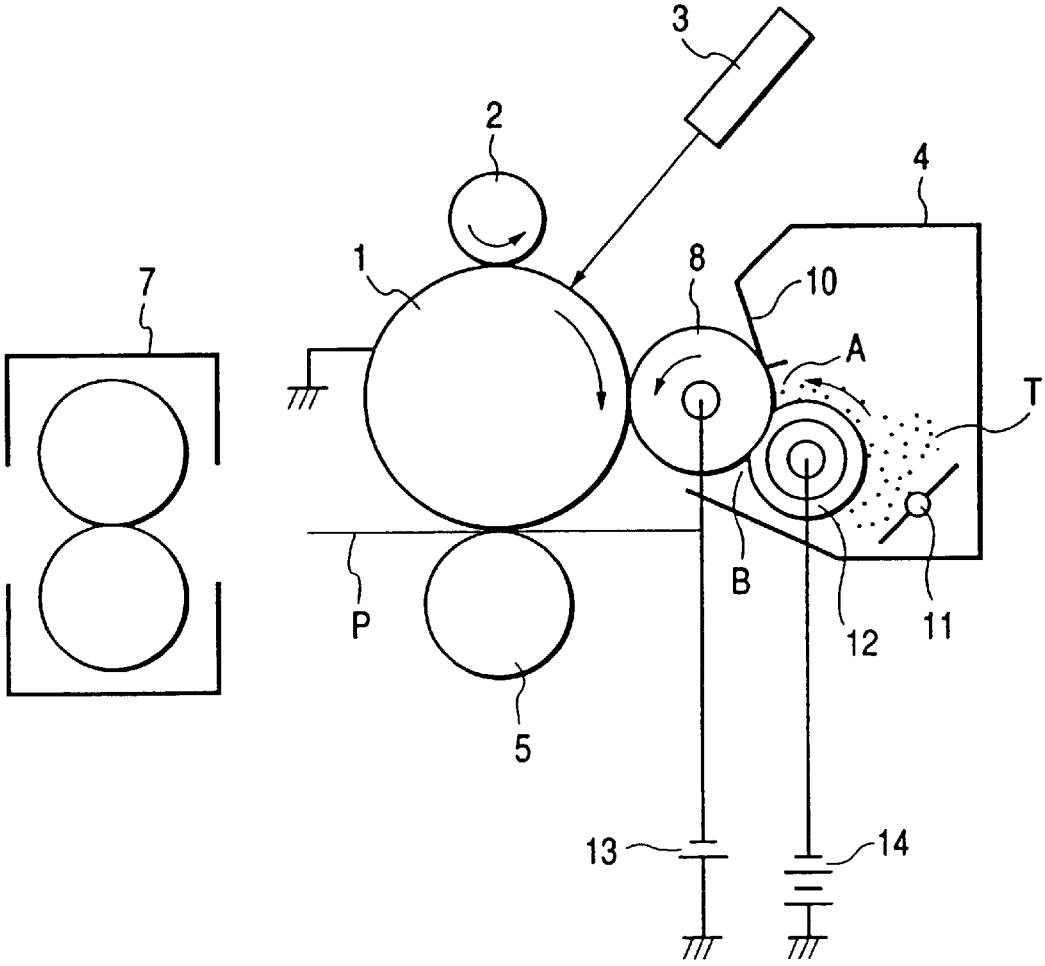
FIG. 6 is a schematic view showing the configuration of another embodiment of the image forming apparatus of the present invention.
Figure 7:
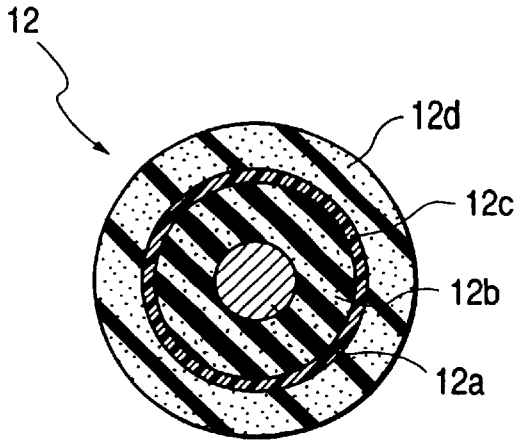
FIG. 7 is a cross-sectional view of an elastic roller serving as a toner feeding member in a developing portion provided in the image forming apparatus shown in FIG. 6.
Figure 8:
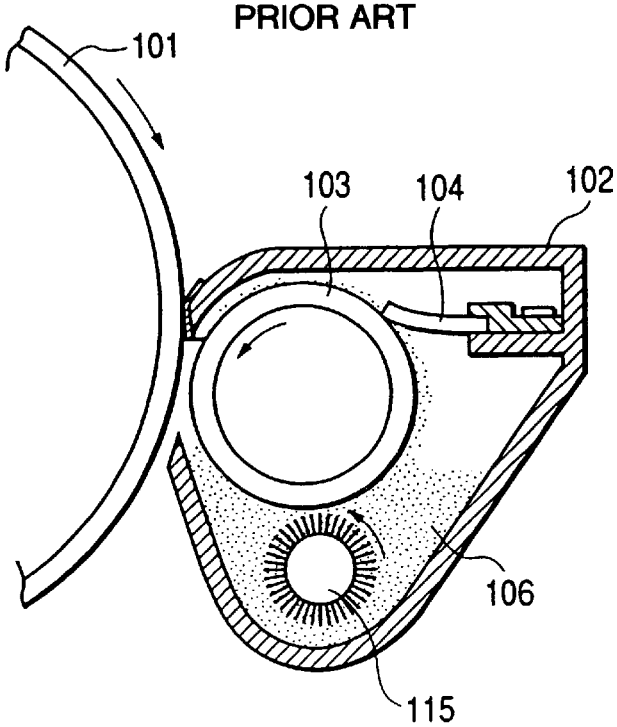
FIG. 8 PRIOR ART
FIG. 8 is a schematic view showing a developing portion in a conventional image forming apparatus.

FIG. 6 is a schematic view showing configuration of another embodiment of the image forming apparatus of the present invention, and FIG. 7 is a cross-sectional view of an elastic roller serving as the toner feeding member of the developing portion in the image forming apparatus shown in FIG. 6.

The present embodiment is featured, in the elastic roller 12 of the developing portion 4, by a conductive toner intrusion preventing layer 12*c* inserted between a base layer 12*b* composed of an open cell foamed member on a metal core 12*a* and an outermost open cell foamed member, and by applying a feeding bias to the toner intrusion preventing layer 12*c* to form an electric field between the developing roller 8 and the elastic roller 12 for biasing the toner toward the developing roller 8. The conductive toner intrusion preventing layer 12*c* is composed of a thin conductive tube with a conductivity no more than $10^6\Omega$.

In the present embodiment, not only the toner intrusion preventing layer 12*c* but also the base layer 12*b* are given a conductivity not more than $10^6\Omega$ (toner scraping layer 12*d* being insulating), and a feeding bias source 14 is connected to the metal core 12*a* as shown in FIG. 6, thereby supplying the toner intrusion preventing layer 12*c* with a feeding bias through the metal core 12*a* and the base layer 12*b*. The feeding bias is selected larger than the developing bias applied from the developing bias source 13 to the developing roller 8.

The presence of the conductive toner intrusion preventing layer 12*c* between the base layer 12*b* and the scraping layer 12*d* and the application of the feeding bias thereto for forming the toner biasing electric field, as explained in the foregoing, provide the following effects.

(1) Firstly, the toner present in the vicinity of the elastic roller 12 can be supplied in a larger amount to the developing roller 12.

Before the toner is rubbed by the elastic roller and the developing roller, the toner is usually present in a weakly charged state around the elastic roller, and is charged by the friction with the elastic roller and the developing roller, thereby being carried thereon by the reflection force. However, in an environment of high temperature and high humidity, the amount of triboelectricity on the toner decreases whereby the amount of toner carried on the developing roller tends to decrease.

In the present embodiment, however, the toner carried on the elastic roller 12 is biased therefrom toward the developing roller 8 by the electric field. Therefore, even if the tribo charge of the toner decreases in the environment of high temperature and high humidity, a large amount of toner can be supplied to the developing roller 8 from the elastic roller 12, in an upstream area A between the elastic roller 12 and the developing roller 8 and after the rubbing area therebetween as shown in FIG. 6.

(2) Secondly, in case a bias is applied for biasing the toner toward the developing roller in the conventional elastic roller consisting of a single foamed sponge layer, a large amount of toner is fed from the elastic roller to the developing roller because of the large thickness of the sponge layer in an environment of low temperature and low humidity, but, in the present embodiment, such feeding of a large amount of toner does not occur even in the environment of low temperature and low humidity, because the toner amount on the developing roller 12 is limited by the toner scraping layer 12*c*.

Thus, in the present embodiment, the toner feeding amount is stabilized in comparison with the conventional configuration even in the environment of high temperature and high humidity or of low temperature and low humidity.

(3) In applying a voltage to the elastic roller, in order to prevent leakage to the developing roller, it is common to form the elastic roller with sponge of a medium resistance ($10^7$ to $10^{10}\Omega$) and to apply the bias to the metal core, so that the formed electric field inevitably becomes uneven. Also the material selection is limited to special material having such medium resistance.

On the other hand, in the present embodiment, the base layer 12*b* is given a conductivity not more than $10^6\Omega$ and the feeding bias is applied to the conductive toner intrusion preventing layer 12*c*, so that the potential becomes uniform on the surface of the toner intrusion preventing layer 12*c* to enable uniform toner feeding to the developing roller 12.

(4) Finally, in case a jam is generated in the course of image formation and the toner remaining on the photosensitive drum is collected onto the developing roller by performing the cleaning simultaneously with development as explained in the first embodiment, the toner will be present on the developing roller in an amount larger than in the ordinary state.

The elastic roller 12 discharges the toner from the scraping layer 12*d* by the electric field, in an area A above the contact portion shown in FIG. 6, so that the scraping layer 12*d* reaches an area B below the contact portion in a state with a reduced toner amount therein. Therefore, the scraping ability of the elastic roller 12 is not lowered, and satisfactory scraping can be attained even if a large amount of toner is present on the developing roller 8, and no drawbacks are encountered even in the cleaning method performing simultaneously with the development.

More specifically, in the present embodiment, the core metal 12*a* of the elastic roller 12 was composed of stainless steel with an external diameter of 5 mm. The base layer 12*b* thereon was formed by open cell foamed silicone rubber sponge (density 0.033 g/cm$^3$, cell diameter 200 to 350 $\mu$m, rubber hardness 10° (Asker C hardness)) with a thickness of 4.3 mm. The preparation of the base layer 12*b* is not limited to foaming in a mold, since the surface of the base layer 12*b* is to be covered by a tube, and it is also possible to execute extrusion molding and to polish the surface of the obtained molded product thereby forming the desired base layer.

The toner intrusion preventing layer 12*c* was formed with a thin conductive urethane tube of a thickness of 50 $\mu$m, obtained by extrusion molding of urethane resin which was rendered conductive by dispersing conductive carbon therein. The thickness of the tube can be within a range of 30 to 300 $\mu$m, since the molding becomes difficult at a thickness not more than 30 $\mu$m and the hardness of the tube becomes excessively high at a thickness not less than 300 $\mu$m.

On the toner intrusion preventing layer 12*c*, the toner scraping layer 12*d* was formed by open cell foamed urethane rubber sponge (density 0.038 g/cm$^3$, cell diameter 100 to 250 $\mu$m, rubber hardness 18° (Asker C hardness)) with a thickness of 1.2 mm. In this manner there was obtained an elastic roller with an external diameter of 16 mm, in which the base layer 12*b* was conductive while the scraping layer 12*d* was insulating.

A feeding bias of −860 V was applied from the feeding bias source 14 to the elastic roller 12, in order to obtain a bias of 400 V with respect to the developing bias of −460 V from the developing bias source 13. The feeding bias source 14 can apply a potential difference of 100 to 600 V with respect to the developing bias source 13. A potential difference not more than 100 V is not effective enough for biasing the toner toward the developing roller 8, while a potential difference not less than 600 V may result in an undesirable discharge phenomenon.

In the present embodiment, the elastic roller 12 was installed in the developing portion shown in FIG. 7 and was subjected to 2000 image formations. At the development, the feeding bias was supplied from the feeding bias source 14 to the metal core 12*a* of the elastic roller 12, thereby forming an electric field for biasing the toner from the elastic roller 12 toward the developing roller 8. As a result, even in an environment with high temperature and high humidity or low temperature and low humidity, with polymerized toner of a small particle size employed as the non-magnetic one-component toner T, there could be obtained satisfactory images faithful to the image information from the beginning to the end of 2000 image formations, without fluctuation in the image density, resulting from fluctuation in the toner feeding, or increase in the fog level and decrease in the charge amount resulting from the toner deterioration.

In the foregoing configuration, the conductive toner intrusion preventing layer 12*c* is formed with a thin conductive tube, but such configuration is not restrictive. For example if the base layer is formed by foaming in a mold and has a skin layer at the surface as in the embodiment 1, a conductive layer may be formed on the surface of such skin layer for example by spray coating of conductive resin and may be used as the toner intrusion preventing layer.

In the present embodiment, as explained in the foregoing, a conductive toner intrusion preventing layer is inserted between a base layer consisting of an open cell foamed member and formed on a conductive metal core of the elastic roller and a toner scraping layer consisting of an open cell foamed member, and a feeding bias is directly or indirectly applied to such intrusion preventing layer to bias the toner by the resulting electric field from the elastic roller toward the developing roller, whereby stable toner feeding to the developing roller is rendered possible even under a change in the environmental condition. Also the freedom of material selection is widened for the elastic roller. As in the embodiment 1, a high image quality can be maintained for a long period even when performing the cleaning method simultaneously with development is employed.

[Embodiment 3]

In the following there will be explained an embodiment of the present invention, wherein portions same as those in the first and second embodiments are represented by same numbers and will not be explained further.

In the first embodiment, a skin layer present on the surface of the base layer consisting of an open cell foamed member is used as the toner intrusion preventing layer. The present embodiment is featured by providing a skin layer on the internal cylindrical surface of a toner scraping layer 15*d* constituting the outermost layer, and using such skin layer as the toner intrusion preventing layer.

Figure 9:
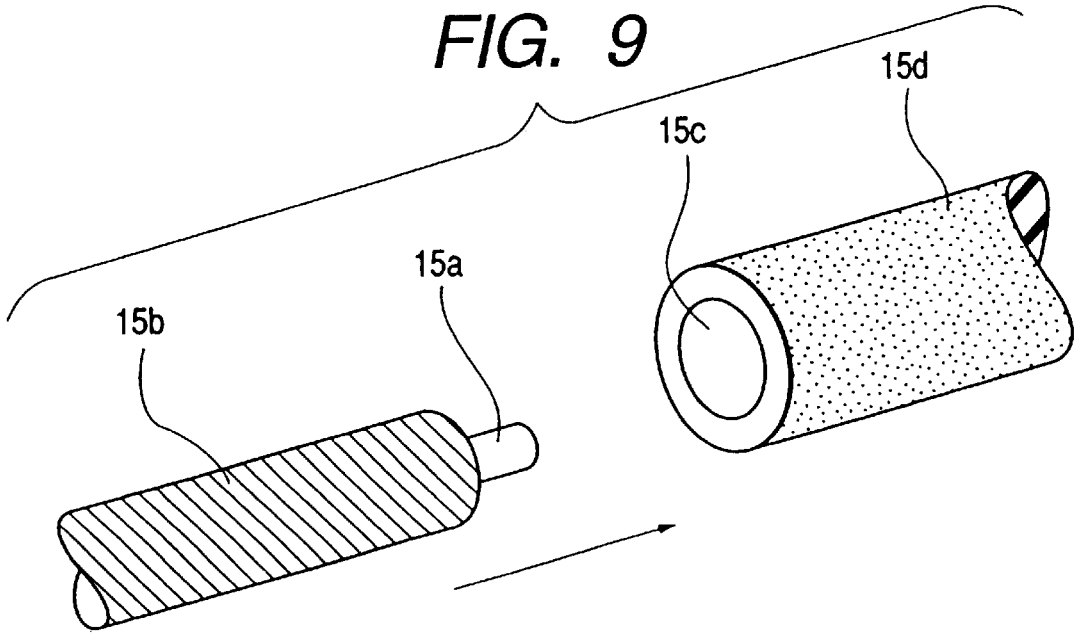
FIG. 9 is a schematic view showing the configuration of an elastic roller.

FIG. 9 is a schematic view showing the configuration of an elastic roller 15 serving as the toner feeding member in the developing portion provided in the image forming apparatus of the present invention.

Referring to FIG. 9, as explained in the foregoing, a base layer 15*b* consisting of an open cell foamed member is formed around a metal core 15*a*. The base layer 15*b* is formed by extrusion molding around the metal core. The base layer 15*b*, formed by extrusion molding and not precise in dimension, is subjected to surface polishing by a polisher. The toner scraping layer 15*d* is formed by injecting rubber into a mold of an injection molder, or by a known method such as the one-shot method explained in the foregoing. As shown in FIG. 9, the molded rubber sponge is formed into a cylindrical shape. In this operation, a skin layer is formed on the peripheral surface of the sponge, along the walls of the mold. Thus formed skin layer on the internal cylindrical surface serves as the toner intrusion preventing layer 15*c*.

Then, as indicated by an arrow in FIG. 9, the base layer 15*b* is inserted inside the toner intrusion preventing layer 15*c*, thereby forming the elastic roller 15 in which the base layer 15*b*, the toner intrusion preventing layer 15*c* and the toner scraping layer 15*d* are laminated in succession on the metal core 15*a*. In this operation, the internal diameter of the toner intrusion preventing layer 15*c* (including the toner scraping layer 15*d*) is made somewhat smaller than the external diameter of the base layer 15*b*, thereby improving mutual contact when the base layer 15*b* is inserted inside the toner intrusion preventing layer 15*c*.

In the present embodiment, the skin layer formed on the internal face of the toner scraping layer 15*d* is utilized as the toner intrusion preventing layer 15*c*.

If the cell diameter is made larger or the density is lowered in order to reduce the rubber hardness, the formation of the skin layer becomes insufficient, resulting in holes in the skin layer or a very thin skin. Therefore the cell diameter and the density have to be suitably selected in case the skin layer is present on the surface of the base layer 15*b*.

However, by forming the skin layer as the toner intrusion preventing layer on the internal surface of the toner scraping layer 15*d* as indicated in the present embodiment, the cell diameter and the density can be arbitrarily selected without considering the influence of the skin layer in forming the base layer 15*b*. As a result, it is rendered possible to increase the cell diameter or decrease the density for obtaining a very low hardness. Further, the freedom in selecting the material and the producing method for the base layer 15*b* is widened, there allowing to use an inexpensive material.

The following elastic roller 15 of the present invention was prepared as explained in the foregoing.

At first, on a stainless steel metal core of a diameter of 5 mm, silicone rubber was extrusion molded with an extrusion molder and vulcanized to obtain an open cell cylindrical formed member, of which surface was then polished. The foamed member had a thickness of 3.5 mm, a density of 0.028 g/cm$^3$, a cell diameter of 500 to 900 $\mu$m, and an Asker C rubber hardness of 6°. The rubber hardness is higher than in the first embodiment, probably because the influence of metal core is reflected on the measurement due to the small thickness of the rubber sponge.

Separately a toner scraping layer 15*d*, having a skin layer on the internal cylindrical surface, was formed with an open cell foamed urethane rubber sponge (density 0.032 g/cm$^3$, a cell diameter 200 to 350 $\mu$m) and the above-mentioned base layer 15*b* was inserted on the internal surface. Thereafter the surface of the toner scraping layer 15*d* was polished to obtain an elastic roller of a diameter of 16 mm. The elastic roller 15 had a rubber hardness of 16°, measured by Asker CsC2 hardness meter (Kobunshi Keiki Co., Ltd.).

In the present embodiment, there is not employed a primer for improving the adhesion between the base layer 15*b* and the toner scraping layer 15*d* having the skin layer on the cylindrical internal surface, but there may be employed known primer for such purpose.

Then the elastic roller of the present invention was mounted in the image forming apparatus and was used in image formation.

The contact pressure of the elastic roller 15 on the developing roller 8 was 20 gf/cm (0.196 N/cm), and could therefore be made lower in order to obtain the desired contact nip.

A bias potential, which is the same as that of the developer roller 8, was applied to the metal core 15*a* of the elastic roller 15 and there was executed a durability test by 2000 image formations. As a result, even when polymerized toner of a small particle size was employed, there could be obtained satisfactory image faithful to the image information and without fog from the beginning to the end of 2000 image formations, without image unevenness resulting from the toner clogging in the elastic roller 15, or an increase in the driving torque of the developing roller 8 or the elastic roller 15, or increase in the fog level or decrease of triboelectricity resulting from toner deterioration caused by the excessive contact pressure on the developing roller 8 or on the toner T.

In the present embodiment, the intrusion preventing layer is provided on the inside of the toner scraping layer, but such configuration is not restrictive and can be combined with the first embodiment. Thus, the toner intrusion preventing layer may be provided both on the external surface of the base layer (first embodiment) and on the internal surface of the toner scraping layer (present embodiment). Such toner intrusion preventing layers provided on both sides improve the reliability thereof and also improve the adhesion at the interface, because of the increased contact area.

As explained in the foregoing, by constituting the elastic roller with plural concentric layers, namely the base layer consisting of open cell foamed member, the intrusion preventing layer and the scraping layer consisting of open cell foamed member, around the conductive metal core, and by integrating the intrusion preventing layer with the internal layer of the scraping layer, there can be achieved a lower hardness of the base layer and a widened freedom of material selection thereof, in addition to the effects of the foregoing embodiments.

[Embodiment 4]

In the following there will be explained a fourth embodiment of the present invention, wherein portions same as those in the foregoing embodiments will be represented by same numbers and will not be explained further.

The present embodiment is featured by constituting the base layer and the toner scraping layer with open cell foamed members but varying the foaming rate of the layers according to the rubber hardness of such base layer and the toner scraping layer.

Foamed rubber is obtained by vulcanizing a rubber material with a foaming agent, but the foamed member assumes open cell structure from closed cell structure depending on the amount of the foaming agent. In practice, however, closed cells may locally remain in the open cell foamed member. Also, in general, the variation in the external shape by the environment is larger for a lower rubber hardness.

Therefore, if the open cell foamed member contains closed cells, the external diameter of the elastic roller varies by the expansion or contraction of such closed cells under the environmental change (temperature or humidity). Such tendency is more conspicuous for a lower rubber hardness. An increase in the external diameter elevates the contact pressure on the developing roller, thereby accelerating the toner deterioration and eventually deteriorating the durability of t he developing portion.

Therefore, in case the base layer and the toner scraping layer are different in the rubber hardness, the present embodiment is to suppress the change in the external diameter under the environmental change, by selecting the open cell rate of the layer of a lower hardness higher than that of the layer of a higher hardness.

The open cell rate can be arbitrarily controlled by varying the amount of the foaming agent in the rubber material. More specifically, an increase or a decrease in the amount of the foaming agent respectively increases or decreases the open cell rate.

The open cell rate mentioned above is measured and adjusted in the following manner:

(a) The specific gravity ρ0 of the rubber material, constituting the principal component of the open cell foamed member, is measured in an unvulcanized state prior to foaming. If the rubber material contains air, the measurement is made after degassing. The measurement is executed according to JIS K 6220.

(b) The weight W0 and the volume V0 of a specimen of the rubber foamed member is measured after foaming.

(c) Then the elastic roller is inserted and fixed in a cylinder having such an internal diameter that the compression rate of the elastic roller becomes 50%, then is immersed in distilled water of 20±5° C. and is maintained for 1 minute in a state where the elastic roller is positioned at about 50 cm below the water surface.

(d) The elastic roller is decompressed in water, and the specimen is left for 5 minutes in water.

(e) The elastic roller is taken out from water, then water drops on the surface are wiped off, and the weight W1 of the specimen is measured.

The open cell rate of the foamed rubber member is calculated as follows:

$$\text{Open cell rate } (\%)=(W1-W0)/(\rho\times V2)\times 100$$

wherein W0: weight (g) of specimen before immersing
W1: weigh (g) of specimen after immersing
V0: volume ($cm^3$) of specimen
V1: volume ($cm^3$) of rubber portion in specimen
V1=W1/ρ0
V2: volume ($cm^3$) of cell portion in specimen
V2=V0−V1
ρ0: specific gravity of unvulcanized rubber material before foaming
ρ: specific gravity of distilled water.

In the elastic roller, the open cell rate of the low hardness elastic foamed member is preferably selected as 50 to 100%. Thus the cell structure contains closed cells and open cells, with a ratio of open cells within a range of 60 to 100%, since an open cell rate not more than 60% approaches a cell structure with closed cells, thereby resulting in a higher rubber hardness of the base layer.

In the present embodiment, the elastic roller was prepared by a method similar to that in the third embodiment, and the amount of the foaming agent was reduced in the scraping layer to adjust the open cell rate.

At first, on a stainless steel metal core of a diameter of 5 mm, silicone rubber was extrusion molded with an extrusion molder and vulcanized to obtain an open cell cylindrical formed member, of which surface was then polished. The foamed member had a thickness of 3.5 mm, a density of 0.032 g/$cm^3$, a cell diameter of 250 to 350 μm, an Asker C rubber hardness of 8°, and an open cell rate of 80%.

Separately a toner scraping layer, having a skin layer on the internal cylindrical surface, was formed with an open cell foamed urethane rubber sponge (density 0.030 g/$cm^3$, a cell diameter 300 to 450 μm, an Asker C rubber hardness 6°). The foaming rate of the scraping layer was 65%. After the above-mentioned base layer was inserted internally, the surface of the toner scraping layer was polished to obtain an elastic roller of a diameter of 16 mm.

The contact pressure between the elastic roller and the developer layer, measured in an environment of low temperature and low humidity (15° C., 12%) and an environment of high temperature and high humidity (31° C., 82%), showed scarce change. Also drawbacks resulting from temperature or humidity could not be observed in durability tests by 2000 image formations in both environments.

As explained in the foregoing, by constituting the elastic roller with plural concentric layers, namely the base layer consisting of open cell foamed member, the intrusion preventing layer and the scraping layer consisting of open cell foamed member, around the conductive metal core, and by changing the open cell rate according to the rubber hardness, there can be preventing the toner deterioration resulting from the change in the external diameter of the elastic roller caused by the environmental change.

As explained in the foregoing, the present embodiment, constituting the elastic roller with plural concentric layers, namely the base layer consisting of open cell foamed member, the intrusion preventing layer and the scraping layer consisting of open cell foamed member, around the conductive metal core, allows to feed the toner of the desired amount to the developing roller while preventing the intrusion of toner into the interior of the elastic roller, and to separate the functions of the base layer and the scraping layer thereby enabling scraping of the toner from the developing roller while maintaining a low contact pressure with the developing roller, whereby high image quality can be maintained over a long period even when performing the cleaning method simultaneously with development.

Also, by constituting the elastic roller with plural concentric layers, namely the base layer consisting of open cell foamed member, the intrusion preventing layer and the scraping layer consisting of open cell foamed member, around the conductive metal core, and by applying a feeding bias to the elastic roller thereby forming an electric field for biasing the toner toward the developing roller, there can be achieved stable toner feeding to the developing roller even under an change in the environment, and a widened freedom of material selection, whereby high image quality can be maintained over a long period even when performing the cleaning method simultaneously with development.

What is claimed is:

1. A developer scraping member for scraping developer from a developer carrying member, comprising:

a surface layer having a foamed member;

a base layer provided inside of said surface layer; and an intrusion preventing layer provided between said surface layer and said base layer, wherein said intrusion preventing layer prevents the developer intruded into said surfaced layer from intruding into said base layer, wherein said surface layer has an open cell foamed member, wherein said base layer has an open cell foamed member, and wherein a cell diameter of said surface layer is smaller than a cell diameter of said base layer.

2. A developer scraping member according to claim 1, wherein said surface layer has a thickness of 0.5 mm to 3 mm.

3. A developer scraping member according to claim 1, wherein a rubber hardness of said surface layer is larger than a rubber hardness of said base layer.

4. A developer scraping member according to claim 1, wherein a thickness of said surface layer does not more than 50% of an entire thickness of said developer scraping member.

5. A developer scraping member according to claim 1, wherein said intrusion preventing layer comprises a first skin layer formed in molding said surface layer, and a second skin layer formed in molding said base layer.

6. A developer scraping member according to claim 1, wherein said intrusion preventing layer is conductive.

7. A developer scraping member according to claim 6, wherein said intrusion preventing layer has a resistance not more than $10^6\Omega$.

8. A developer scraping member, for scraping developer from a developer carrying member, comprising:

a surface layer having a foamed member;

a base layer provided inside of said surface layer; and an intrusion preventing layer provided between said surface layer and said base layer, wherein said intrusion preventing layer prevents the developer intruded into said surfaced layer from intruding into said base layer, wherein said surface layer has an open cell foamed member, wherein said base layer has an open cell foamed member, and wherein either of said surface layer and said base layer, having a smaller rubber hardness, has a smaller open cell rate.

9. A developer scraping member for scraping developer from a developer carrying member, comprising:

a surface layer having a foamed member;

a base layer provided inside of said surface layer; and an intrusion preventing layer provided between said surface layer and said base layer, wherein said intrusion preventing layer prevents the developer, intruding into said surface layer, from intruding into said base layer, wherein said intrusion preventing layer is a skin layer formed in molding said surface layer, and wherein said base layer includes a foamed member.

10. A developer scraping member for scraping developer from a developer carrying member, comprising:

a surface layer having a foamed member;

a base layer provided inside of said surface layer; and an intrusion preventing layer provided between said surface layer and said base layer, wherein said intrusion preventing layer prevents the developer, intruding into said surface layer, from intruding into said base layer, wherein said intrusion preventing layer is a skin layer formed in molding said base layer, and wherein said base layer includes a foamed member.

11. A developer scraping member according to any one of claims 8, 9 and 10, wherein said surface layer has a thickness of 0.5 mm to 3 mm.

12. A developer scraping member according to any one of claims 8, 9 and 10, wherein a cell diameter of said surface layer is smaller than a cell diameter of said base layer.

13. A developer scraping member according to claim 12, wherein a rubber hardness of said surface layer is larger than a rubber hardness of said base layer.

14. A developer scraping member according to any one of claims 8, 9, and 10, wherein a thickness of said surface layer is not more than 50% of an entire thickness of said developer scraping member.

15. A developer scraping member according to any one of claims 8, 9 and 10, wherein said intrusion preventing layer is conductive.

16. A developer scraping member according to claim 15, wherein a resistance of said intrusion preventing layer is not more than $10^6\Omega$.

17. A developing apparatus comprising:

a developer carrying member carrying developer;

a developer scraping member for scraping the developer from said developer carrying member, wherein said developer scraping member includes:

a surface layer having a foamed member;

a base layer provided inside of said surface layer; and an intrusion preventing layer provided between said surface layer and said base layer, wherein said intrusion preventing layer prevents the developer intruded into said surface layer from intruding into said base layer, wherein said surface layer has an open cell foamed member, wherein said base layer has an open cell foamed member, and wherein a cell diameter of said surface layer is smaller than a cell diameter of said base layer.

18. A developing apparatus according to claim 17, wherein said surface layer has a thickness of 0.5 mm to 3 mm.

19. A developing apparatus according to claim 17, wherein a rubber hardness of said surface layer is larger than a rubber hardness of said base layer.

20. A developing apparatus according to claim 17, wherein a thickness of said surface layer does not more than 50% of an entire thickness of said developer scraping member.

21. A developing apparatus according to claim 17, wherein said intrusion preventing layer comprises a first skin layer in molding said surface layer, and a second skin layer formed in molding said base layer.

22. A developing apparatus according to claim 17, wherein said intrusion preventing layer is conductive.

23. A developing apparatus according to claim 22, wherein said intrusion preventing layer has a resistance not more than $10^6\Omega$.

24. A developing apparatus comprising:

a developer carrying member carrying developer;

a developer scraping member for scraping the developer from said developer carrying member, wherein said developer scraping member includes:

a surface layer having a foamed member;

a base layer provided inside of said surface layer; and an intrusion preventing layer provided between said surface layer and said base layer, wherein said intrusion preventing layer prevents the developer intruded into said surface layer from intruding into said base layer, wherein said surface layer has an open cell foamed member, wherein said base layer has an open cell foamed member, and wherein either of said surface layer and said base layer, having a smaller rubber hardness, has a smaller open cell rate.

25. A developing apparatus comprising:

a developer carrying member carrying developer;

a developer scraping member for scraping the developer from said developer carrying member, wherein said developer scraping member includes:

a surface layer having a foamed member;

a base layer provided inside of said surface layer; and an intrusion preventing layer provided between said surface layer and said base layer, wherein said intrusion preventing layer prevents the developer intruded into said surface layer from intruding into said base layer, wherein said intrusion preventing layer is a skin layer formed in molding said surface layer, and wherein said base layer includes a foamed member.

26. A developing apparatus comprising:

a developer carrying member carrying developer;

a developer scraping member for scraping the developer from said developer carrying member, wherein said developer scraping member includes:

a surface layer having a foamed member;

a base layer provided inside of said surface layer; and an intrusion preventing layer provided between said surface layer and said base layer, wherein said intrusion preventing layer prevents the developer intruded into said surface layer from intruding into said base layer, wherein said intrusion preventing layer is a skin layer formed in molding said base layer, wherein said base layer includes a foamed member.

27. A developer scraping member according to any one of claims 24, 25 and 26, wherein said surface layer has a thickness of 0.5 mm to 3 mm.

28. A developer scraping member according to any one of claims 24, 25 and 26, wherein a cell diameter of said surface layer is smaller than a cell diameter of said base layer.

29. A developer scraping member according to claim 28, wherein a rubber hardness of said surface layer is larger than a rubber hardness of said base layer.

30. A developer scraping member according to any one of claims 24, 25 and 26, wherein a thickness of said surface layer is not more than 50% of an entire thickness of said developer scraping member.

31. A developer scraping member according to any one of claims 24, 25 and 26, wherein said intrusion preventing layer is conductive.

32. A developer scraping member according to claim 31, wherein a resistance of said intrusion preventing layer is not more than $10^6\Omega$.

33. A developer scraping member according to any one of claims 17, 24, 25 and 26, wherein said developing apparatus is capable of collecting a residual developer on an image bearing member while an electrostatic image formed on said image bearing member is developed with the developer.

34. A developer scraping member for scraping developer from a developer carrying member, comprising:

a surface layer having a foamed member;

a base layer provided inside of said surface layer; and an intrusion preventing layer provided between said surface layer and said base layer, wherein said intrusion preventing layer prevents the developer intruding into said surface layer from intruding into said base layer, wherein a cell diameter of said surface layer is smaller than a cell diameter of said base layer.

35. A developer apparatus comprising:

a developer carrying member carrying developer;

a developer scraping member for scraping the developer from said developer carrying member, wherein said developer scraping member includes:

a surface layer having a foamed member;

a base layer provided inside of said surface layer; and an intrusion preventing layer provided between said surface layer and said base layer, wherein said intrusion preventing layer prevents the developer intruding into said surface layer from intruding into said base layer, wherein a cell diameter of said surface layer is smaller than a cell diameter of said base layer.

36. A developer scraping member for scraping developer from a developer carrying member, comprising:

a surface layer having a foamed member;

a base layer provided inside of said surface layer; and an intrusion preventing layer provided between said surface layer and said base layer, wherein said intrusion preventing layer prevents the developer intruded into said surface layer from intruding into said base layer;

wherein said surface layer includes an open cell member; and wherein said base layer has an open cell foamed member.

37. A developer scraping member according to claim 36, wherein said surface layer has a thickness of 0.5 mm to 3 mm.

38. A developer scraping member according to claim 36, wherein a rubber hardness of said surface layer is larger than a rubber hardness of said base layer.

39. A developer scraping member according to claim 36, wherein either of said surface layer and said base layer, having a smaller rubber hardness, has a smaller open cell rate.

40. A developer scraping member according to claim 36, wherein a thickness of said surface layer does not more than 50% of an entire thickness of said developer scraping member.

41. A developer scraping member according to claim 36, wherein said intrusion preventing layer is a skin layer formed in molding said surface layer.

42. A developer scraping member according to claim 36, wherein said intrusion preventing layer is a skin layer formed in molding said base layer.

43. A developer scraping member according to claim 36, wherein said intrusion preventing layer comprises a first skin layer formed in molding said surface layer, and a second skin layer formed in molding said base layer.

44. A developer scraping member according to claim 36, wherein said intrusion preventing layer is conductive.

45. A developer scraping member according to claim 44, wherein said intrusion preventing layer has a resistance not more than $10^6\Omega$.

46. A developing apparatus comprising:

a developer carrying member carrying developer;

a developer scraping member for scraping the developer from said developer carrying member, wherein said developer scraping member includes:

a surface layer having a foamed member;

a base layer provided inside of said surface layer; and an intrusion preventing layer provided between said surface layer and said base layer, wherein said intrusion preventing layer prevents the developer intruded into said surface layer from intruding into said base layer, wherein said surface layer has an open cell foamed member, and wherein said base layer has an open cell foamed member.

47. A developing apparatus according to claim 46, wherein said surface layer has a thickness of 0.5 mm to 3 mm.

48. A developing apparatus according to claim 46, wherein a rubber hardness of said surface layer is larger than a rubber hardness of said base layer.

49. A developing apparatus according to claim 46, wherein either of said surface layer and said base layer, having a smaller rubber hardness, has a smaller open cell rate.

50. A developing apparatus according to claim 46, wherein either of said surface layer and said base layer, having a smaller rubber hardness, has a smaller open cell rate.

51. A developing apparatus according to claim 46, wherein a thickness of said surface layer does not more than 50% of an entire thickness of said developer scraping member.

52. A developing apparatus according to claim 46, wherein said intrusion preventing layer is a skin layer formed in molding said surface layer.

53. A developing apparatus according to claim 46, wherein said intrusion preventing layer is a skin layer formed in molding said base layer.

54. A developing apparatus according to claim 46, wherein said intrusion preventing layer comprises a first skin layer in molding said surface layer, and a second skin layer formed in molding said base layer.

55. A developing apparatus according to claim 46, wherein said intrusion preventing layer is conductive.

56. A developing apparatus according to claim 55, wherein said intrusion preventing layer has a resistance not more than $10^6\Omega$.

* * * * *

UNITED STATES PATENT AND TRADEMARK OFFICE

CERTIFICATE OF CORRECTION

PATENT NO. : 6,345,166 B1
DATED : February 5, 2002
INVENTOR(S) : Katsuhiro Sakaizawa et al.

It is certified that error appears in the above-identified patent and that said Letters Patent is hereby corrected as shown below:

Column 2,
Line 54, “intrude” should read -- intrude into --; and
Line 58, “satisfactory” should read -- satisfactorily --.

Column 3,
Line 37, “developing” should read -- developer --; and
Line 56, “from” should be deleted.

Column 4,
Line 6, “drawing.” should read -- drawings. --.

Column 5,
Line 63, “as” should be deleted.

Column 7,
Line 13, “are” should be deleted.

Column 8,
Line 22, “carried” should read -- being carried --.

Column 9,
Line 40, “set” should read -- set in --.

Column 12,
Line 14, “rang” should read -- range --;
Line 40, “antioffset” should read -- anti-offset --; and
Line 55, “cross sectional” should read -- cross-sectional --.

Column 14,
Line 4, “is” (second occurrence) should read -- be --.

Column 15,
Line 20, “an” should read -- in --; and
Line 63, “simultaneous” should read -- simultaneously --.

Column 17,
Line 26, “in the cleaning method performing” should read -- when performing the cleaning method --.

Column 19,
Line 30, “there” should read -- thereby --.

UNITED STATES PATENT AND TRADEMARK OFFICE

CERTIFICATE OF CORRECTION

PATENT NO. : 6,345,166 B1
DATED : February 5, 2002
INVENTOR(S) : Katsuhiro Sakaizawa et al.

It is certified that error appears in the above-identified patent and that said Letters Patent is hereby corrected as shown below:

Column 20,
Line 55, “t he” should read -- the --; and
Line 57, “the” (second occurrence) should read -- the goal of --.

Column 22,
Line 9, “preventing” should read -- preventing of --;
Line 46, “surfaced” should read -- surface --; and
Line 61, “does” should read -- is --.

Column 23,
Line 12, “surfaced” should read -- surface --.

Column 24,
Line 20, “does” should read -- is --.

Column 26,
Line 4, “layer;” should read -- layer, --;
Line 5, “member;” should read -- member, --;
Lines 19 and 66, “does” should read -- is --.

Signed and Sealed this

Sixth Day of August, 2002

*Attest:*

*Attesting Officer*

JAMES E. ROGAN
*Director of the United States Patent and Trademark Office*